US006508332B2

(12) United States Patent
Fahl et al.

(10) Patent No.: US 6,508,332 B2
(45) Date of Patent: Jan. 21, 2003

(54) ELEVATOR CAR DOOR LOCKING AND UNLOCKING MECHANISM

(75) Inventors: Richard Lee Fahl, Fairfield, OH (US); Mark Thomas Davidson, Hamilton, OH (US); Mark H. Bayyari, Lebanon, OH (US); Takeshi Sugimoto, Westchester, OH (US)

(73) Assignee: Fujitec America, Inc., Lebanon, OH (US)

( * ) Notice: Subject to any disclaimer, the term of this patent is extended or adjusted under 35 U.S.C. 154(b) by 0 days.

(21) Appl. No.: 09/902,143

(22) Filed: Jul. 10, 2001

(65) Prior Publication Data

US 2002/0056594 A1 May 16, 2002

Related U.S. Application Data

(60) Provisional application No. 60/248,918, filed on Nov. 15, 2000.

(51) Int. Cl.[7] ..... B66B 13/14

(52) U.S. Cl. ..... 187/316; 49/120

(58) Field of Search ..... 187/313, 314, 187/315, 316, 318, 319, 321, 332, 334, 335; 49/116, 118, 120, 122, 360, 362

(56) References Cited

U.S. PATENT DOCUMENTS

| | | | | | |
|---|---|---|---|---|---|
| 2,517,713 | A | | 8/1950 | Rissler | 187/31 |
| 4,015,688 | A | * | 4/1977 | Mangel | 187/319 |
| 4,364,454 | A | | 12/1982 | Glaser et al. | 187/57 |
| 4,491,200 | A | * | 1/1985 | Thompson et al. | 187/314 |
| 4,926,974 | A | * | 5/1990 | Morris et al. | 187/314 |
| 4,934,488 | A | | 6/1990 | Umemura | 187/57 |
| 5,083,639 | A | | 1/1992 | Kappeler | 187/51 |
| 5,105,916 | A | | 4/1992 | Steacy et al. | 187/52 |
| 5,139,112 | A | | 8/1992 | Tonna et al. | 187/57 |
| 5,329,075 | A | * | 7/1994 | Hirabayashi et al. | 187/316 |
| 5,575,357 | A | * | 11/1996 | Spiess | 187/319 |
| 5,636,715 | A | | 6/1997 | Hayashi et al. | 187/330 |
| 5,641,951 | A | | 6/1997 | Cai et al. | 187/317 |
| 5,690,188 | A | | 11/1997 | Takakusaki et al. | 187/319 |
| 5,988,320 | A | * | 11/1999 | Mittermayr | 187/319 |
| 6,164,417 | A | * | 12/2000 | Oberleitner | 187/319 |
| 6,189,658 | B1 | * | 2/2001 | Karner | 187/319 |
| 6,328,133 | B1 | * | 12/2001 | Kim | 187/315 |
| 6,340,073 | B1 | * | 1/2002 | Lee et al. | 187/309 |

* cited by examiner

*Primary Examiner*—Jonathan Salata
(74) *Attorney, Agent, or Firm*—Frost Brown Todd LLC

(57) ABSTRACT

An elevator car door opening and closing apparatus is taught having a clutch assembly carried by each car door for coupling with a landing door locking and unlocking assembly whereby the car and landing doors open and close simultaneously. The clutch assembly includes a four bar mechanical expanding and collapsing parallelogram linkage which engages, unlocks, and opens the landing door. Mechanical linkage is also attached to the parallelogram linkage whereby the elevator car doors may only be forced opened a limited amount if the car is stalled between landing sites.

11 Claims, 12 Drawing Sheets

ELEVATOR CAR DOOR LOCKING AND UNLOCKING MECHANISM

RELATED APPLICATIONS

This is a non-provisional application based upon an earlier filed provisional application Ser. No. 60/248,918 filed Nov. 15, 2000.

BACKGROUND OF THE INVENTION

The present invention generally relates to elevator car door opening and closing apparatus. More specifically the present invention relates to an elevator car door opening apparatus wherein the active door operating mechanism is carried upon the elevator car and car door and an inexpensive, landing door unlocking and opening mechanism is attached to the landing door. A mechanical elevator car door locking mechanism is included which is inherently disabled when the car is within a reasonable distance of a landing site but which otherwise only permits the doors to be opened by an amount insufficient for passengers, within the car, to exit.

PRIOR ART

Heretofore complex and expensive landing door opening mechanisms have been attached to the landing door at each individual landing site. An example of such a mechanism may be found in U.S. Pat. No. 5,690,188, for an "Elevator Door System" issued to Takakusaki et al. on Nov. 25, 1997 wherein simple, inexpensive car door opening roller assemblies are placed on the car doors and complex, expensive, vane assemblies are placed on each landing site door. This arrangement can prove very costly in a high rise building having a large number of floors served by multiple elevators since the expensive vane assemblies must be provided on each and every landing site door.

BRIEF SUMMARY OF THE PRESENT INVENTION

The present invention overcomes the shortcomings of the referenced prior art by placing relatively inexpensive landing door opening roller assemblies on the landing doors and placing a more efficient clutch assembly on the elevator car door that engages the landing door roller assembly when the car doors are opened thereby opening both car and landing doors simultaneously in a more efficient and economical manner. Therefore, the more expensive clutch assembly need only be provided on the elevator car and not on each and every landing site door; a definite economical advantage in high rise buildings having a large number of landing sites served by one or more elevator cars.

The present invention teaches a new and improved clutch assembly, attached to the elevator car door comprising an assembly of mechanical links that form an expanding and collapsing mechanical parallelogram that is linked to the car door opening mechanism. The mechanical parallelogram is configured such that two parallel sides thereof provide a pair of vertically oriented gripping links that move laterally toward or away from each other as the mechanical parallelogram expands or collapses. A cam wheel, operated by the door opening mechanism, expands and/or collapses the mechanical parallelogram.

As the elevator car approaches and stops at a landing site, a pair of rollers attached to the landing door's locking mechanism enters the slot between the vertically oriented gripping links of the mechanical parallelogram. As the elevator doors begin to open, by action of the car door opening mechanism, the cam wheel is caused to rotate thereby collapsing, or closing, the vertical gripping links upon the landing door rollers coupling the landing door to the elevator car door and unlocking the landing doors. With the landing doors unlocked and coupled to the elevator car doors, the car doors and landing doors are opened simultaneously by the car door opening mechanism.

By reversing the elevator car door opening mechanism, the elevator car doors and the landing doors are simultaneously closed and the gripping links are expanded or opened, by the reverse rotation of the cam wheel, thereby releasing their grip upon the landing door rollers whereby the landing doors are again locked and the elevator car is free to move on to another landing site.

In the event of an emergency such as an unexpected electrical power failure, the door opening system, as taught and disclosed herein, further provides a simple and economical way to prevent the opening of the elevator car doors, by onboard passengers, beyond a predetermined amount if the elevator car is not within reasonable distance of a landing zone.

If the elevator car is not within a reasonable distance of a landing site the landing door locking and unlocking rollers will not be between the vertical gripping links of the mechanical parallelogram. Therefore, if the passengers, in a stalled elevator car, push the car doors open, the gripping links, of the mechanical parallelogram will close or collapse toward each other farther than possible when the landing door locking and unlocking rollers are present. The additional travel of the mechanical parallelogram gripping links may be advantageously used to mechanically activate, by appropriate mechanical linkage, a car door latch mechanism that will limit the amount of car door separation.

DETAILED DESCRIPTION OF THE PREFERRED EMBODIMENT

Figure 1:
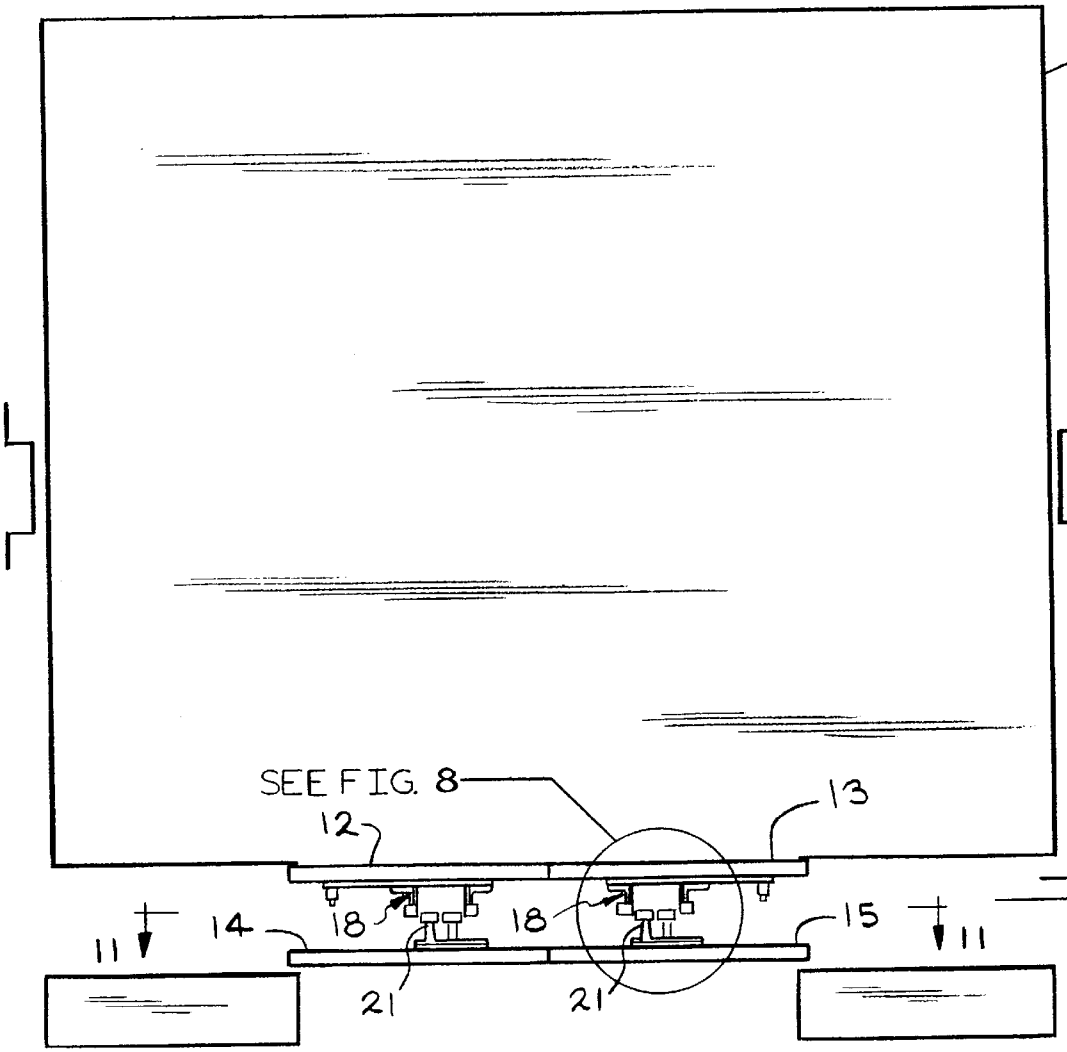
FIG. 1 presents a view looking downward on the top of a typical elevator car, embodying the present invention, stopped at a landing site.

FIG. 1 presents a top view of a typical elevator car 10 positioned at a typical landing site and embodying the present invention. As illustrated, in FIG. 1, the elevator car doors 12 and 13 are in alignment with landing doors 14 and 15 respectively. A door opening clutch assembly 18, attached to each car door 12 and 13, is in engaging alignment with a pair of landing door unlocking and opening roller assemblies 21.

When car 10 stops at a given landing, car doors 12 and 13 are opened by means of clutch assemblies 18 which, because of their engagement with roller assemblies 21 on landing doors 14 and 15 also unlock and open landing doors 14 and 15.

Figure 2:
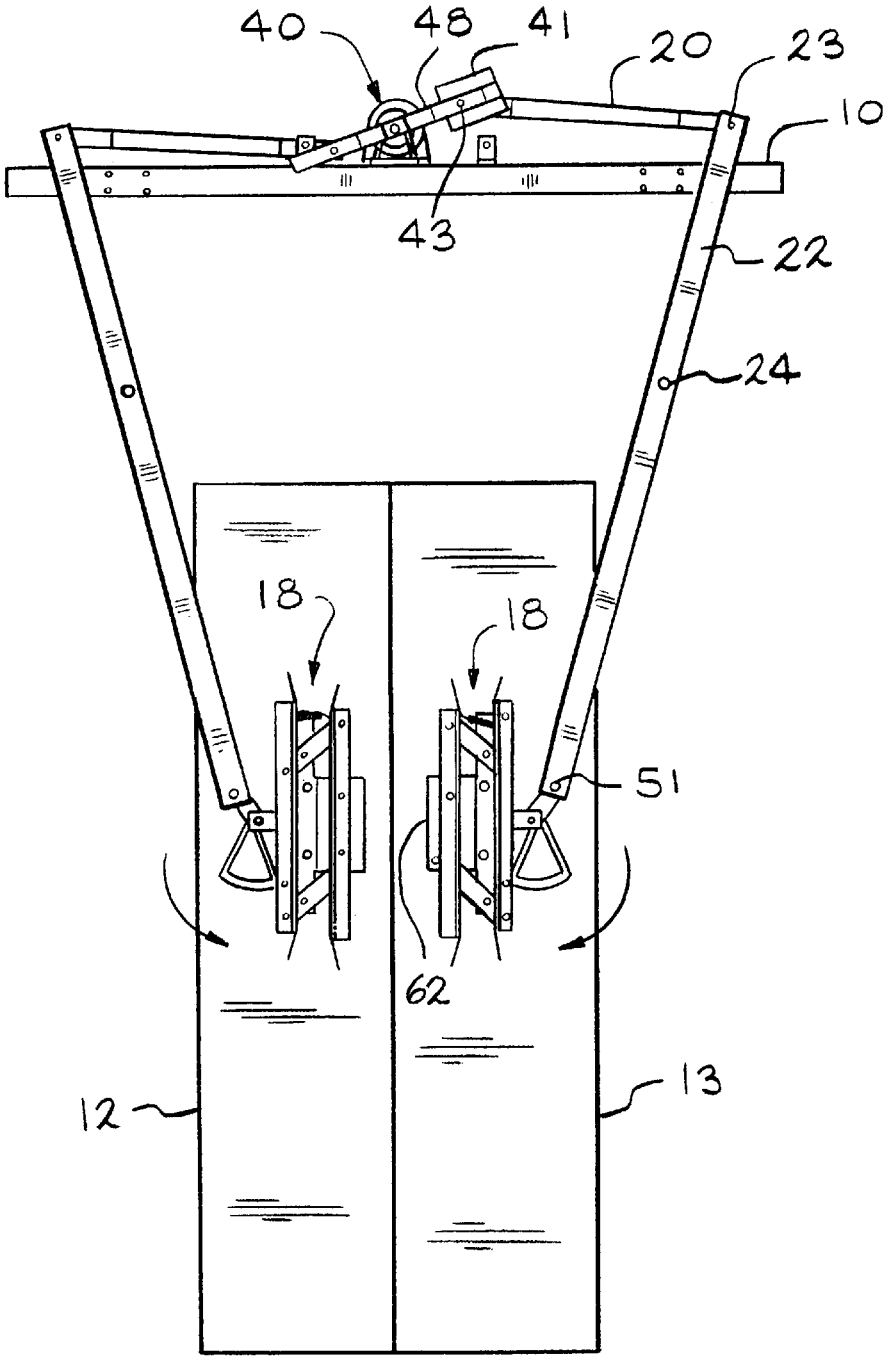
FIG. 2 presents an elevational, view of a pair of elevator car doors in the closed configuration and embodying the present invention.
Figure 4:
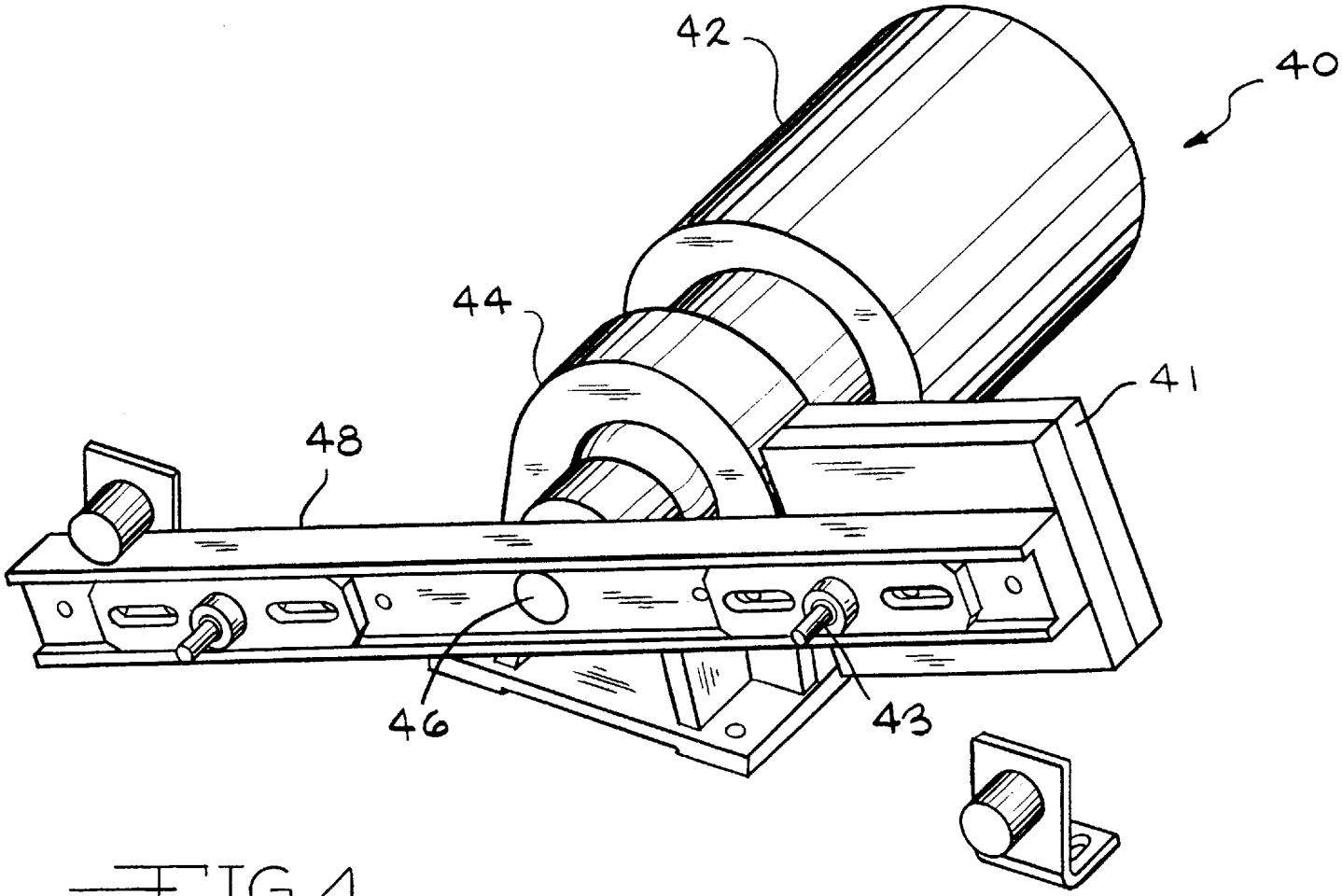
FIG. 4 presents a pictorial view of the elevator door power drive assembly of the present invention.

Referring now to FIG. 2, car doors 12 and 13 are illustrated in their closed position. A door opening power drive assembly 40 is affixed to the top of car 10. Referring now to FIG. 4, drive assembly 40 preferably comprises an electric motor 42 coupled to a speed reducing torque multiplier 44 preferably having a speed reduction ratio of 29 to 1. Although any speed reducing apparatus may be used it is preferable that a "cyclo" or cyclodial type speed reducer be used. A suitable cyclo speed reducer has been found to be Cyclo Speed Model CNHX-4100Y-29 marketed by Sumitomo Machinery Corporation of America. The cyclo speed reducer operates by the action of an eccentric cam mounted on the input shaft of the speed reducer. The eccentric cam rotates within a bore inside a cyclodial disc forcing the cyclodial disc to roll inside a ring gear housing. As the input shaft, and the eccentric cam, rotate, the cyclodial disc advances a given distance in the opposite direction thereby producing a speed reduction. The amount of speed reduction is determined by the specific design of the cyclodial disc and the ring gear housing. The primary advantage of the cyclodial speed reducer is that it has no elements operating in shear as in a typical geared speed reducer. In a cyclodial speed reducer all moving elements operate in compression. Thus a valuable benefit is realized, namely long life and no catastrophic failure is possible. Further, because of the rolling action, the cyclo speed reducer is more quiet than speed reducers using gears. This is particularly important for a device mounted on top of an elevator car where because of its box like structure, can amplify sounds to the passengers within the car.

Attached to output shaft 46 of speed reducer 44 is a typical door actuating arm 48 having a typical counter weight 41 attached thereto as illustrated. However, any other traditional drive assembly, such as the belt drive assemblies as illustrated in U.S. Pat. Nos. 4,926,975 and 5,690,188, may be used in combination with the present invention.

The continuing detailed description of the present invention will be further described as it applies to the right hand elevator door 13 and its associated landing door 15. However, it is to be understood that the invention, hereinbelow, may be equally applied to the left hand door 12, as also illustrated in the figures, by one skilled in the relevant art.

Figure 5:
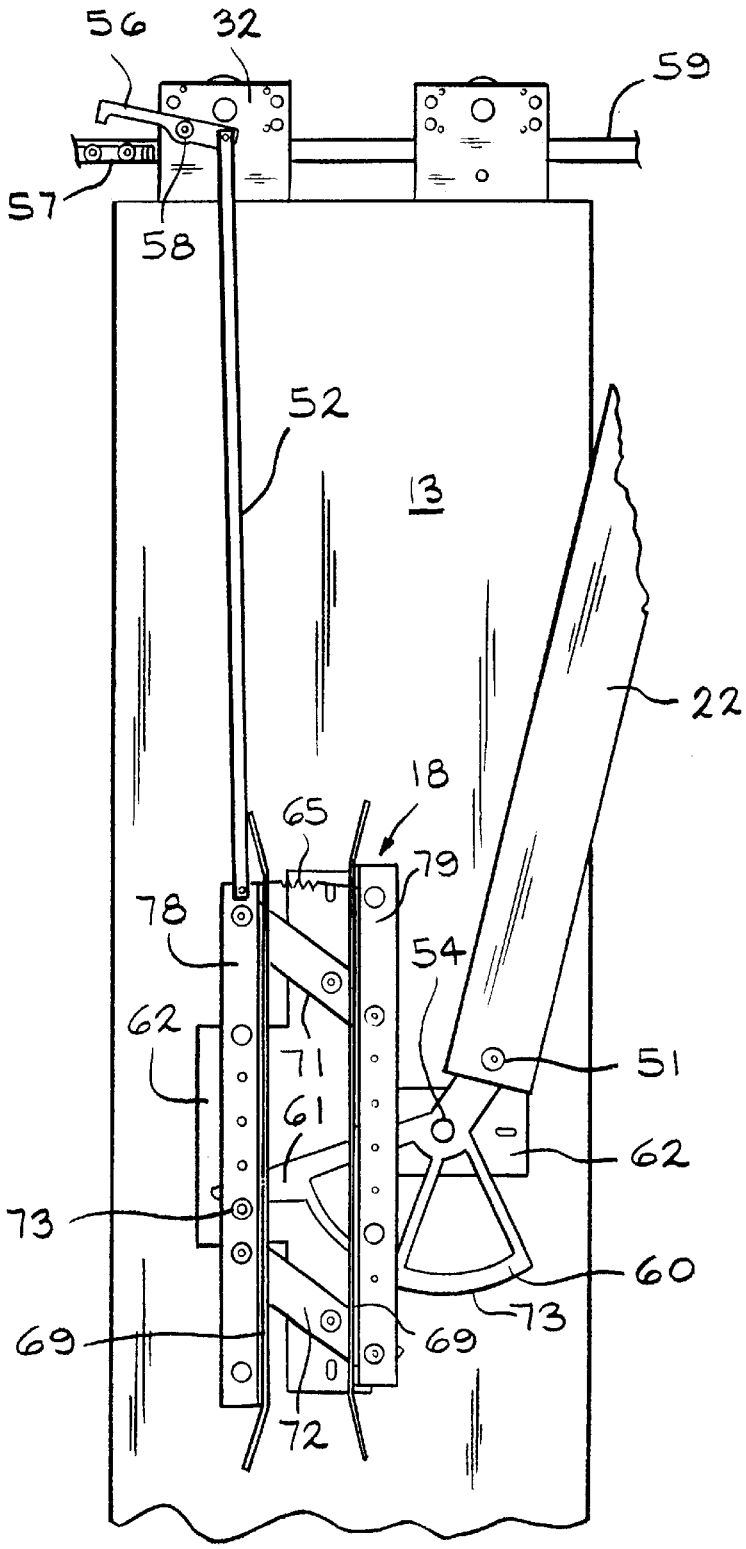
FIG. 5 presents an elevational view of the right side car door embodying the present invention.
Figure 6:
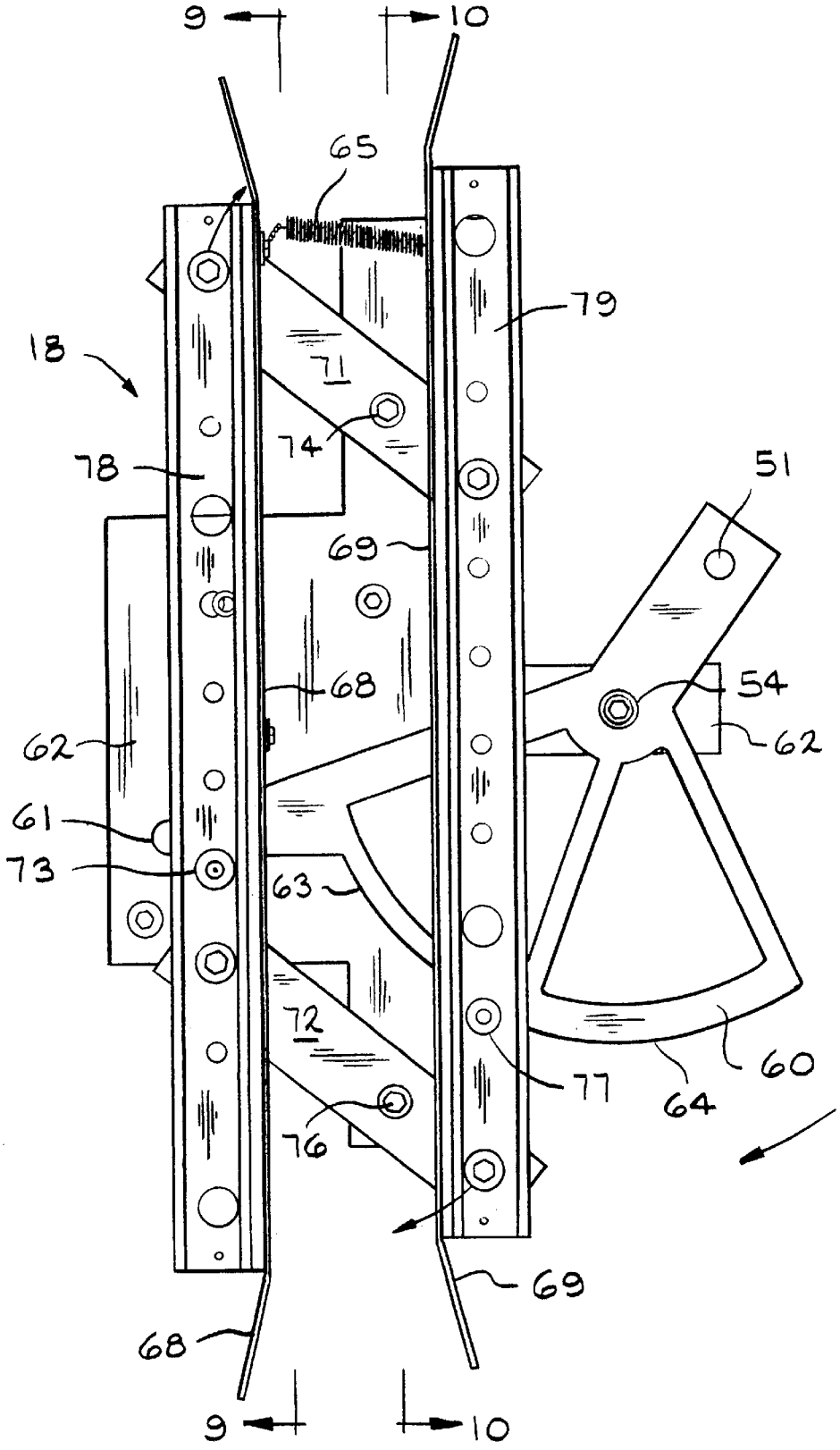
FIG. 6 presents an enlarged elevational view of the door opening clutch assembly shown in FIG. 5.
Figure 7:
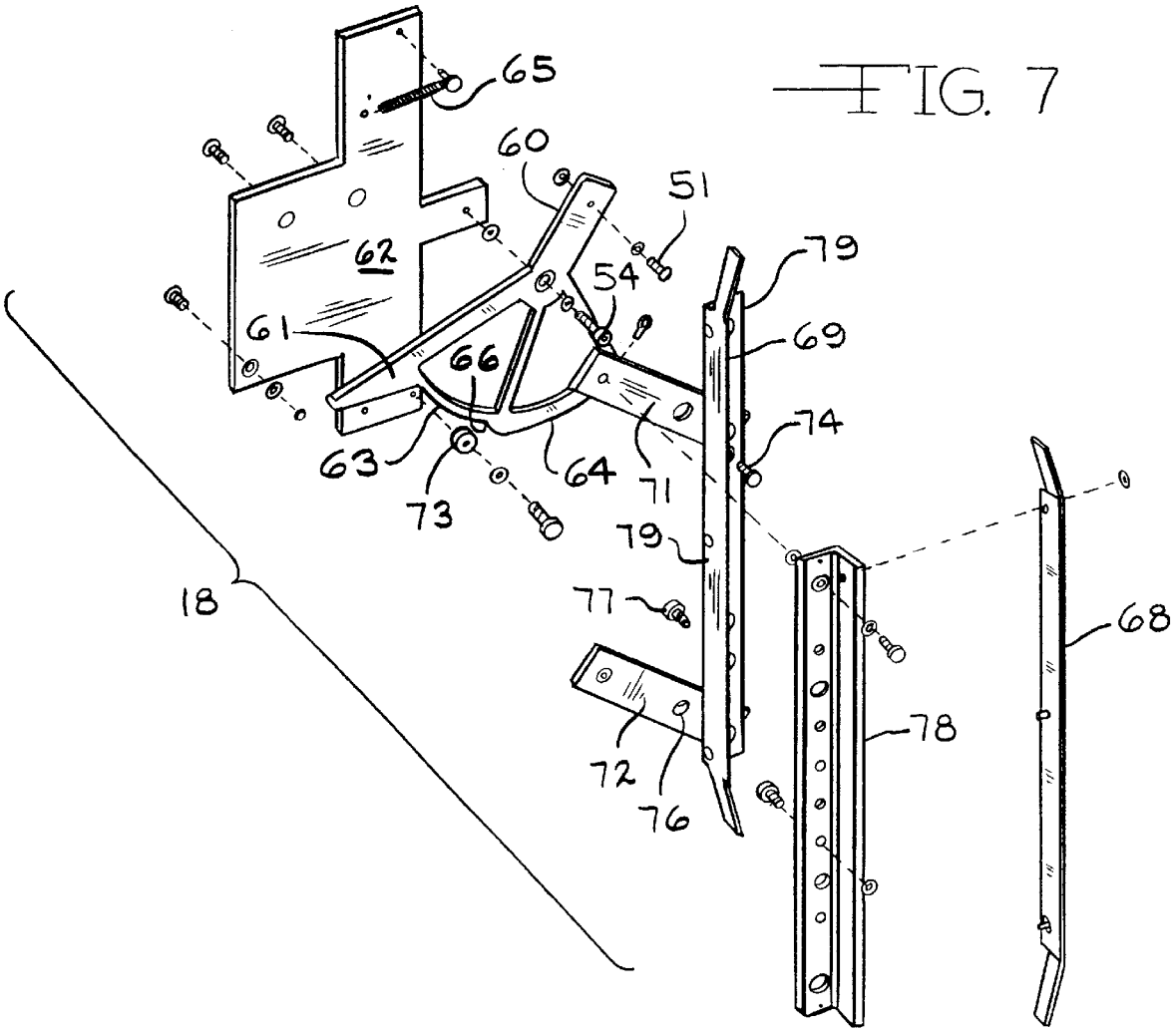
FIG. 7 presents an exploded view of the elements comprising the car door opening clutch assembly as illustrated in FIGS. 5 and 6.

Referring now to FIGS. 2, 5, and 6, door drive link 20 is pivotally attached to pivot pin 43 of actuating arm 48 of power drive assembly 40. Link 20 is pivotally attached to door opening link 22 at pivot 23. Door opening link 22 is pivotally attached to the car body at pivot 24. Link 22 is also pivotally attached to rotatable cam link 60, of clutch assembly 18, at pivot 51. Rotatable cam link 60 is pivotally attached to clutch mounting plate 62 by pivot pin 54. Clutch mounting plate 62 is typically attached to door 13, as illustrated in FIG. 5, by any convenient means. FIG. 7 provides an exploded view of clutch assembly 18 as applied to door 13.

Figure 3:
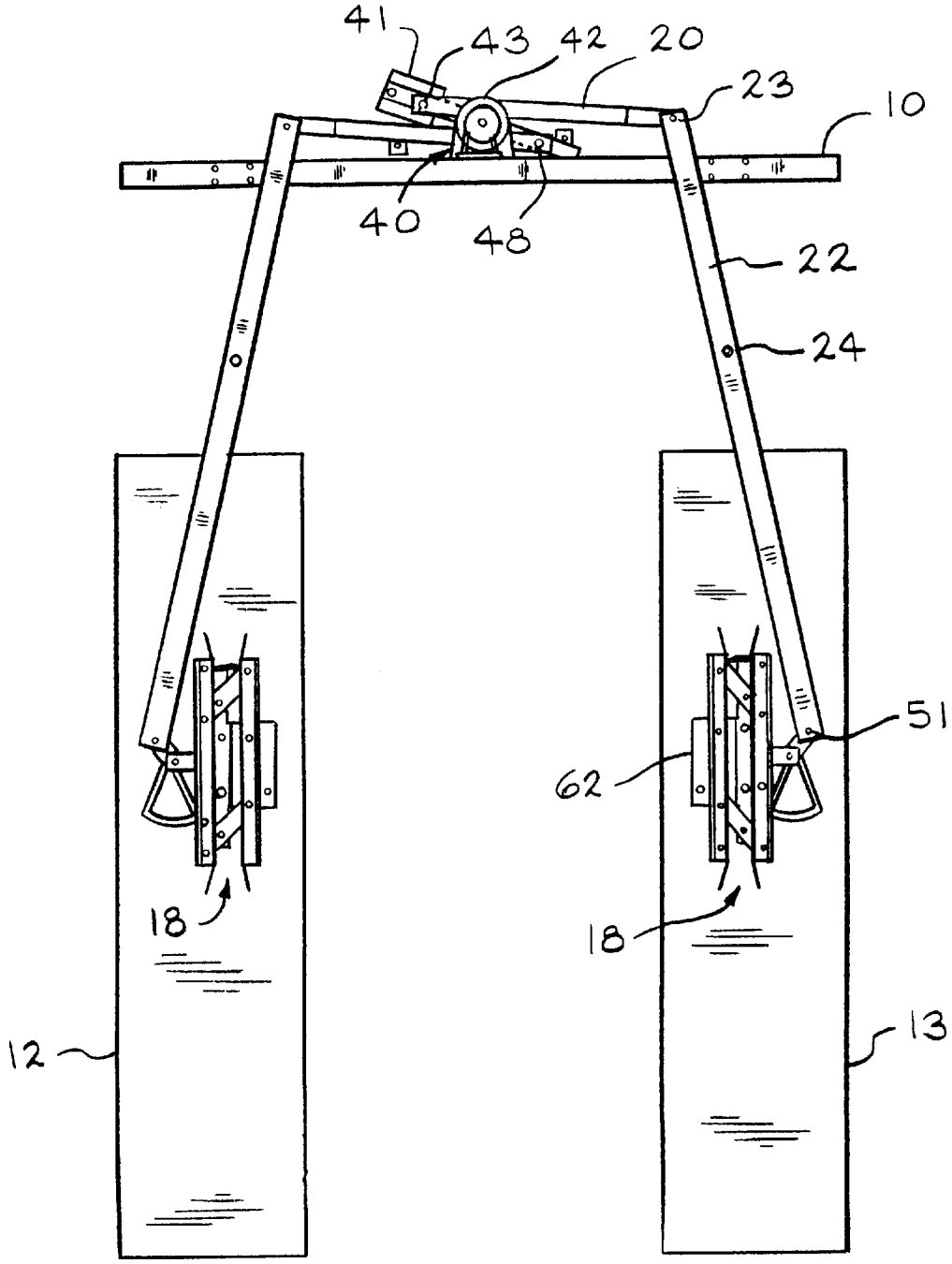
FIG. 3 presents an elevational view of a pair of elevator car doors in the open configuration and embodying the present invention.

To open doors 12 and 13, power drive assembly 40 is energized whereby actuating arm 48 rotates counterclockwise, as viewed in FIG. 2, thereby causing link 20 to translate to the left whereby link 22 rotates, counterclockwise about pivot 24 dragging door 13 to its open position as illustrated in FIG. 3. To close doors 12 and 13, the process is simply reversed.

Referring now to FIGS. 2, 3, 5, 6, 7, 9 and 10. Clutch assembly 18, preferably, comprises a base or mounting plate 62 which is affixed to the hoist side of elevator door 13. Pivotally attached to base plate 62 are a pair of laterally disposed, diagonal links 71 and 72. Diagonal links 71 and 72 are pivotally attached to base plate 62 by pivot pins 74 and 76 respectively such that links 71 and 72 are free to rotate in a plane parallel to the plane of base plate 62. Pivotally attached to the opposite ends of diagonal links 71 and 72 are vertical links 78 and 79 as illustrated in FIG. 6. Thus links 71, 72, 78, and 79 form a movable parallelogram whereby the theoretical area, therein, may be expanded and/or collapsed. Link 79 is provided a cam follower, or roller, 77 projecting into the plane of rotation of links 71 and 72. Similarly vertical link 78 includes pin 73 extending into the plane of rotation of links 71 and 72.

Figure 9:
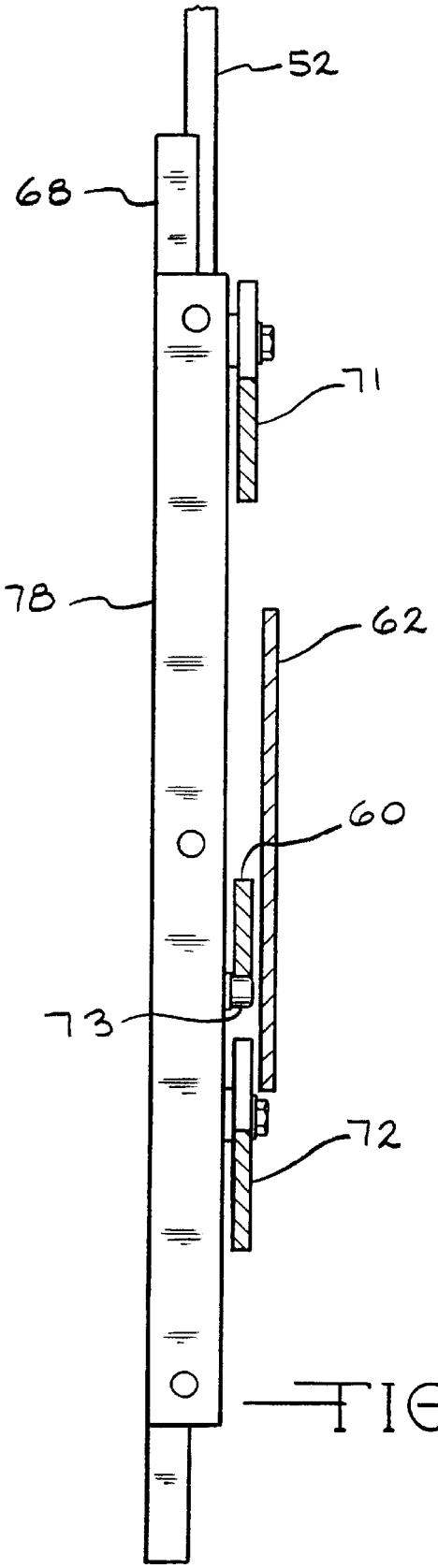
FIG. 9 presents an elevational view taken along line 9—9 in FIG. 6.
Figure 10:
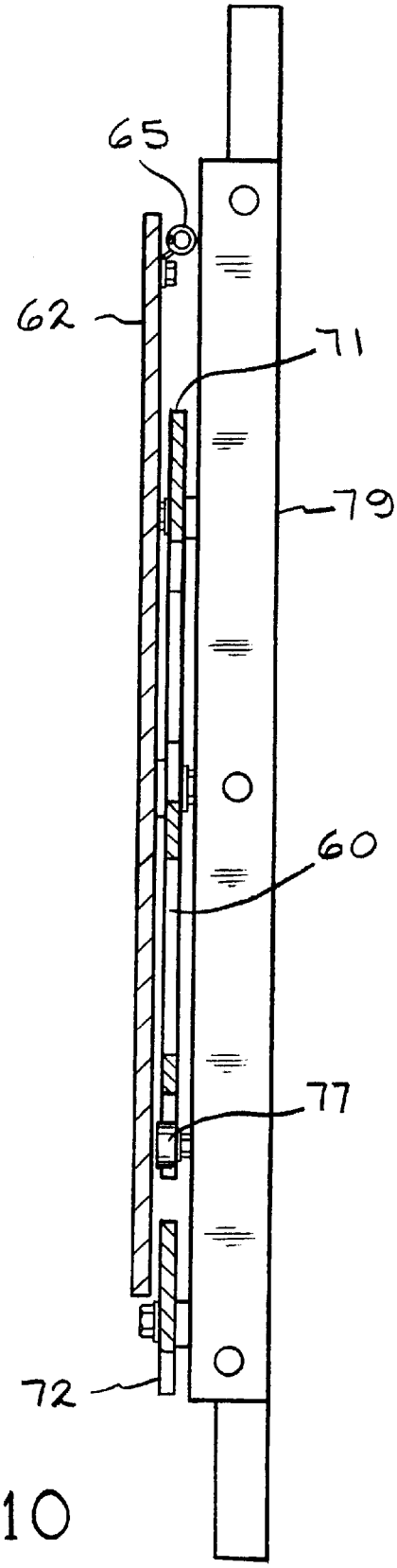
FIG. 10 presents an elevational view taken along line 10—10 in FIG. 6.

Cam wheel 60 is pivotally attached to base plate 62 by pivot pin 54 whereby cam link 60 is free to rotate within the plane of links 71 and 72 between base plate 62 and vertical links 78 and 79 as illustrated in FIGS. 9 and 10. Cam wheel 60 has two cam surfaces 63 and 64. Both cam surfaces 63 and 64 are of a circular configuration concentric about pivot 54 with surface 64 being of a larger radius than surface 63. A camming ramp, or step, 66 acts as a transition from surface 63 to surface 64. Extending radially outward from cam surface 63 is arm 61. The function of cam surfaces 63 and 64, ramp 66, and arm 61 will be described more fully below.

When car doors 12 and 13 are in there respective closed position, as illustrated in FIG. 2, all elements of clutch assembly 18, on car door 13, are positioned as shown in FIGS. 5 and 6. Cam arm 61 is in engagement with pin 73 on vertical link 78 thereby preventing tension spring 65 from collapsing the collapsible parallelogram formed by links 71, 72, 78, and 79. Cam follower 77, on vertical link 79, is in engagement with, or slightly removed from cam surface 63 and immediately adjacent to ramp 66 between cam surfaces 63 and 64.

As car door 13 begins to open, by virtue of the horizontal force applied by link 22 through cam wheel 60 and pivot 54, cam wheel 60 begins to rotate clockwise on door 13 (counterclockwise on door 12) see FIG. 2. As cam wheel 60 rotates clockwise, cam arm 61 rises releasing its hold on pin 73 and ramp 66 engages cam follower 77, on vertical link 79, and with the assistance of tension spring 65, forces vertical link 79 downward and vertical link 78 upward thereby causing vertical links 78 and 79 to move laterally toward one another by action of the collapsing parallelogram formed by links 71, 72, 78, and 79.

Figure 8:
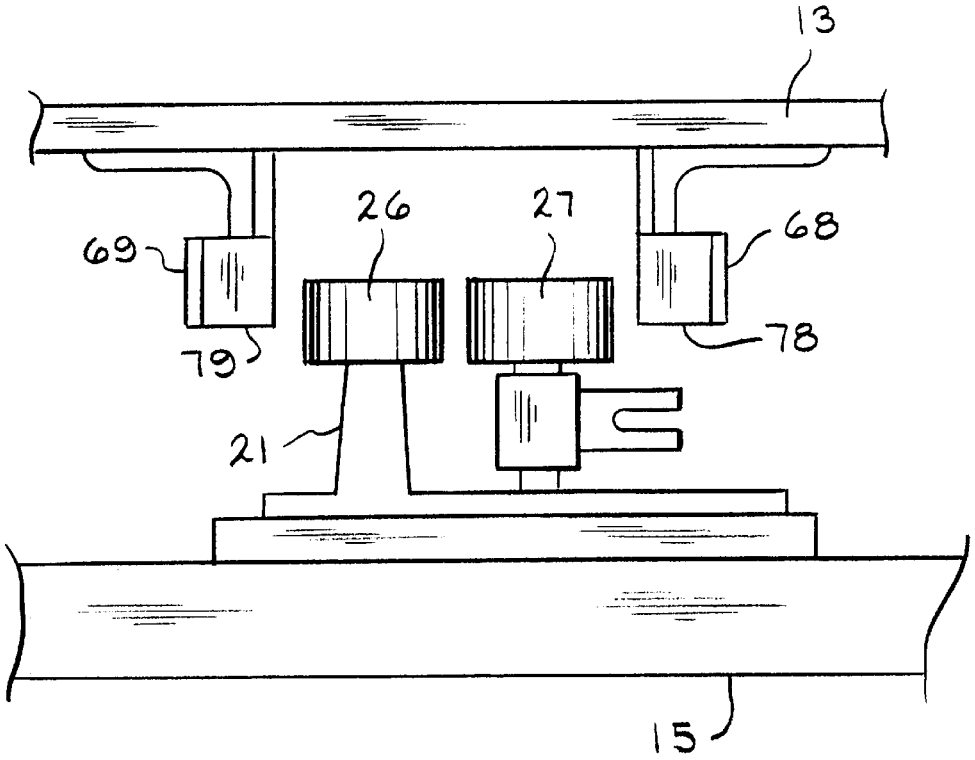
FIG. 8 presents a plan view of the landing door opening rollers about to be engaged by the elevator door opening clutch assembly.
Figure 11:
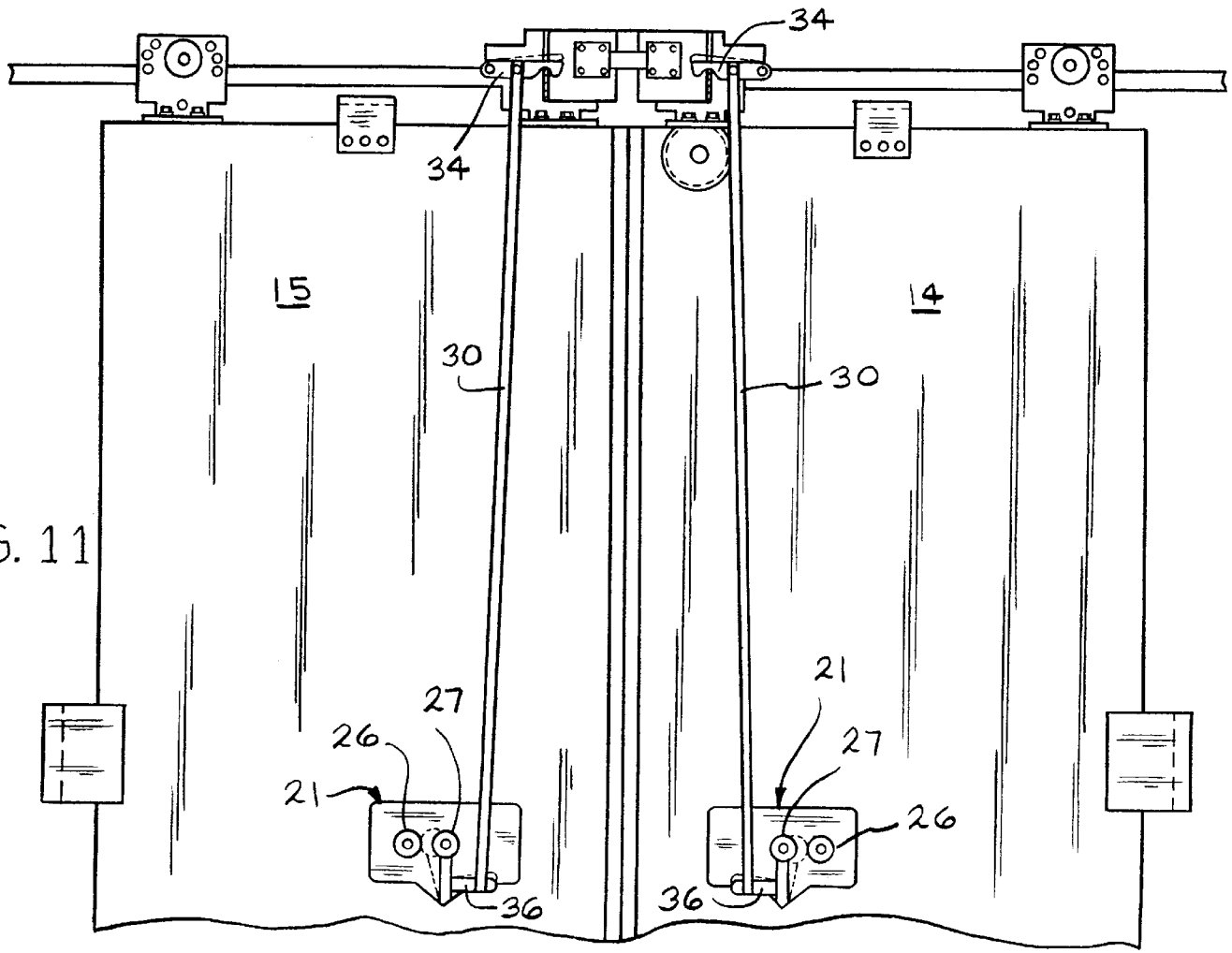
FIG. 11 presents an elevational view taken along line 11—11 in FIG. 1.

Referring now to FIGS. 1, 8 and 11. If elevator car 10 is in a landing zone, or safely close to a landing, door unlocking and opening rollers 26 and 27, of roller coupling assembly 21, will be positioned between vertical links 78 and 79 of clutch assembly 18 as illustrated. As shown in FIG. 11, rollers 26 and 27 are typically positioned side by side with roller 26 rigidly affixed to assembly 21 while roller 27 is permitted to move laterally approximately one quarter of an inch. When coupling assembly 21 is positioned between vertical links 78 and 79 each roller, 26 and 27, is typically provided approximately one quarter of an inch clearance between roller surface and vertical links 78 and 79 respectively. Thus when the collapsing parallelogram formed by links 71, 72,78, and 79 closes upon rollers 26 and 27 vertical link 79 need only translate one quarter of an inch to engage roller 26 however, vertical link 78 must not only translate one quarter of an inch to engage roller 27 but it must also translate an additional quarter of an inch pushing roller 27 to its lateral stop to firmly grip coupling assembly 21. Therefore, in order to provide the additional travel required by vertical link 78 lateral links 71 and 72 are eccentrically pivoted about pivots 74 and 76 respectively, whereby link 78 will move faster and laterally further than link 79 by virtue of the longer pivot radius about pivots 74 and 76.

As roller 27 is pushed toward roller 26 by vertical link 79 door unlatching link 30 is caused to move vertically thereby unlatching door locking lever 34 permitting the door to open.

When elevator car doors 12 and 13 close, by action of power drive 40, cam wheel 60, on door 13, will rotate counterclockwise, as viewed in FIGS. 5 and 6, whereby cam arm 61 will engage pin 73, on vertical link 78, and by overcoming the force of tension spring 65 force vertical link 78 downward causing vertical links 78 and 79 to separate releasing their grip upon door opening rollers 26 and 27 and thereby returning clutch assembly 18 to its closed door configuration permitting elevator car 10 to move on to another landing. Roller 27 being pivotally biased to separate from roller 26, because of the weight of link 30 upon lever arm 36, will separate from roller 26 thereby causing the landing door locking lever 34 to engage and lock the landing door from being forced open.

In the event Elevator car 10 stops outside a landing zone, for example as a result of a power failure, elevator car doors 12 and 13 might be pushed open by passengers inside the car by overcoming the resisting torque of power drive assembly 40. However, it is desirable that car doors 12 and 13 be pushed open only to a given position to permit air ventilation within the car. Clutch 18 further acts to limit the car door opening as described in greater detail below.

FIG. 5 illustrates an optional feature that may be added to the present invention. Attached to a door suspension assembly 32 of car door 13 by pivot 58 is latching arm 56. Latching arm 56 is connected to vertical link 78 of clutch assembly 18 by link 52 as illustrated.

Figure 5A:
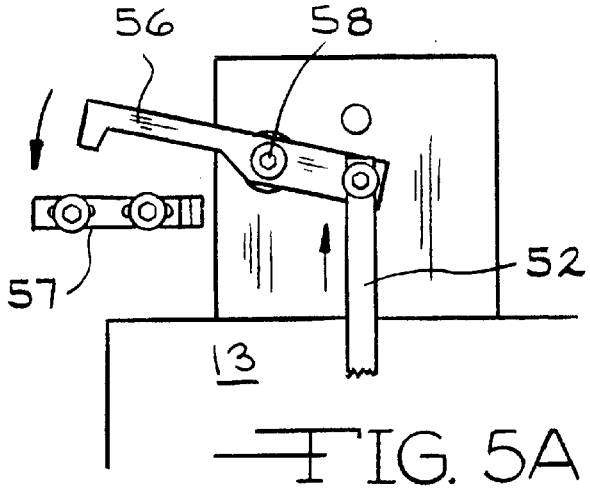
FIGS. 5A through 5C illustrates the operation of an elevator car door safety latch.
Figure 5B:
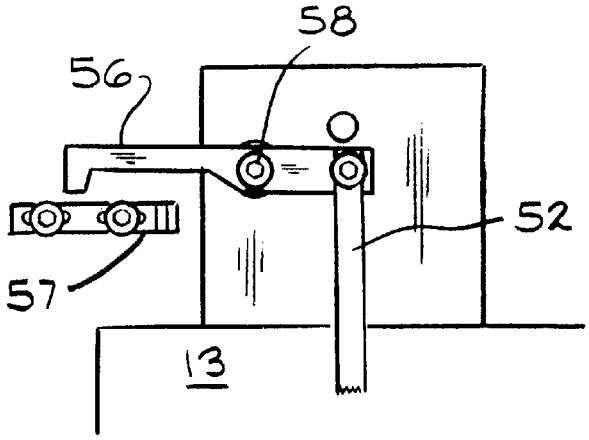
Figure 5C:
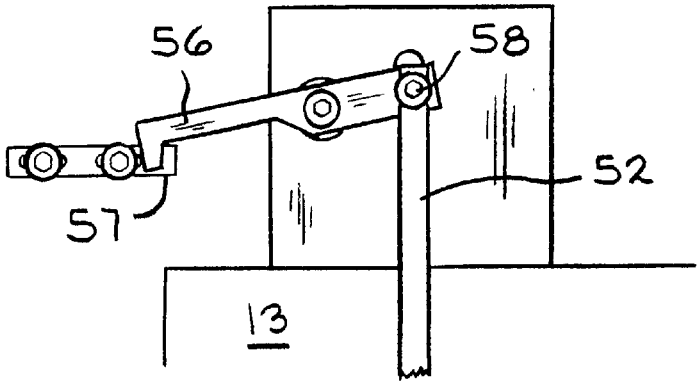

Referring additionally to FIGS. 5A, 5B, and 5C. If car 10 stops outside a landing zone, rollers 26 and 27, of landing door coupling assembly 21, will not be positioned between vertical links 78 and 79 of clutch assembly 18. Thus if car doors 12 and 13 are forced open, clutch assembly 18 will function as described above whereby cam wheel 60 will rotate clockwise, by action of links 22, and 20, and actuating arm 48 of power drive assembly 40 whereby arm 61 of cam wheel 60 will rotate clockwise and upward, as viewed in FIGS. 5 and 6, thereby releasing its hold upon pin 73. Vertical links 78 and 79, now being unrestricted, and being drawn together by action of tension spring 65 may close more fully than when roller coupling assembly 21 is therebetween.

Upon collapse of the parallelogram formed by links 71, 72, 78, and 79, vertical link 78 is permitted to move further upward than it would if a landing door coupling assembly 21 was therebetween, thereby, similarly, forcing latching link 52 further upward causing latch 56 to rotate counterclockwise about pivot 58. As door 13 moves further, latching link 56 progressively rotates downward, as illustrated in FIGS. 5A, 5B, and 5C until latch 56 travels over center, as illustrated in FIG. 5C, whereby latch 56 will engage bracket 57 attached to door rail 59 thereby preventing further opening of door 13.

Preferably vertical links 78 and 79 also includes roller engaging plates 68 and 69, respectively, having diverging end flanges as illustrated in the figures. The diverging end flanges, of plates 68 and 69 serve to guide rollers 26 and 27, of roller coupling assembly 21, there between, see FIGS. 8 and 11, when the elevator car is reengaging the hoistway rollers 26 and 27 after manual disengagement for maintenance purposes.

Although the preferred embodiment as disclosed herein teaches an elevator having two car doors with two associated landing doors wherein a separate clutch assembly is included for each car door, the clutch assembly as described and claimed herein may also be effectively used on an elevator car having a single car door with a single associated landing door. Further the clutch assembly, as taught and claimed herein, may be used on an elevator car having two car doors wherein a single clutch assembly is positioned on one "master" door and the second car door is "slaved" to the master door and operated by means such as cables, gears or mechanical linkages.

It should be further understood, by those skilled in the art, that various other changes, modifications, omissions and/or additions in form and detail of the preferred embodiment taught herein may be made therein without departing from the spirit and scope of the claimed invention.

We claim:

1. An elevator car door opening and closing system comprising:

a landing door slidingly attached to a landing site, said landing door including coupling means, positioned on the hoist side of said door, for opening and closing said door, an elevator car door slidingly attached to an elevator car, door opening and closing apparatus for simultaneously opening and closing said landing door and said car door said apparatus comprising:

an electrically powered door operator attached to said elevator car for opening and closing said doors, clutch means affixed to the hoist side of said elevator car door and kinematicly attached to said door operator, said clutch means including a single mechanical expanding and collapsing parallelogram linkage whereby said collapsing parallelogram linkage engages said landing door coupling means such that said landing door opens and closes simultaneously with said elevator car door.

2. The system as claimed in claim 1 wherein said coupling means includes at least one roller having an axis of rotation normal to said landing door.

3. The system as claimed in claim 1 wherein said coupling means includes two rollers having their axis of rotation normal to said landing door.

4. The system as claimed in claim 1 wherein said clutch means comprises:

a planer base plate affixed to the hoist side of said elevator car door, first and second laterally disposed links, vertically separated, and attached, to said base plate, said first and second laterally disposed links each having first and second opposite ends thereof, said first and second link each rotatable about a pivot selectively positioned between said first and second opposite ends whereby said first and second links freely rotate in a plane parallel to said base plate, a first vertically disposed link pivotally attached to the first lateral ends of each first and second laterally disposed link and a second vertically disposed link pivotally attached to the second lateral end of each first and second laterally disposed link whereby said first and second laterally disposed links, in combination with said first and second vertically disposed links, form said collapsing parallelogram whereby the lateral distance between said first and second vertically disposed links may be selectively varied by rotation of said first and second laterally disposed links about their respective pivots, a rotatable cam wheel pivotally attached to said base plate whereby said cam wheel lies within the plane of said first and second laterally disposed links, a cam follower affixed to said second vertically disposed link and projecting into the plane of said first and second laterally disposed links whereby said cam follower engages the cam surface of said rotatable cam wheel, thereby causing the lateral distance between said first and second vertically disposed links to vary, as said cam wheel rotates, said vertically disposed links engaging or disengaging said coupling means there between, depending upon the rotation of said cam wheel, mechanical link means connecting said cam wheel and said door operator whereby said door operator opens and closes said car door while simultaneously rotating said cam wheel.

5. The system as claimed in claim 4 wherein said elevator car includes mechanical lock means whereby said car doors may not be fully opened when said coupling means is not positioned between said vertically disposed links, said mechanical lock means comprising:

mechanical linkage attached to at least one of said vertically disposed links and said mechanical lock means whereby movement of said vertically disposed link, beyond a selected position, acts upon said mechanical linkage to deploy said mechanical lock means thereby preventing the opening of said elevator door beyond a predetermined position.

6. The system as claimed in claim 5 wherein said elevator doors are supported upon a laterally extending rail by door supporting roller assemblies attached to said doors and said mechanical lock means comprises a laterally disposed latching arm pivotally attached to one of said door supporting roller assemblies for engaging hook means selectively positioned upon said rail or said other door.

7. The system as claimed in claim 4 wherein said the pivots about which said laterally disposed links rotate are eccentrically positioned between said first and second lateral ends.

8. A clutch mechanism for use in an elevator opening and closing system comprising:

a planer base plate, first and second laterally disposed links, vertically separated, and pivotally attached, to said base plate, said first and second laterally disposed links each having first and second laterally opposed ends thereof, said first and second link each rotatable about a pivot selectively positioned between said first and second opposite ends whereby said first and second links freely rotate in a plane parallel to said base plate, a first vertically disposed link pivotally attached to the first lateral ends of each first and second laterally disposed link and a second vertically disposed link pivotally attached to the second lateral end of each first and second laterally disposed link whereby said first and second laterally disposed links, in combination with said first and second vertically disposed links, form a collapsing parallelogram whereby the lateral distance between said first and second vertically disposed links may be selectively varied by rotation of said first and second laterally disposed links about their respective pivots, a rotatable cam wheel pivotally attached to said base plate whereby said cam wheel generally lies within the plane of said first and second laterally disposed links, a cam follower affixed to one of said vertically disposed link and projecting into the plane of said first and second laterally disposed links whereby said cam follower engages the cam surface of said rotatable cam wheel, thereby causing the lateral distance between said first and second vertically disposed links to vary, as said cam wheel rotates.

9. The clutch mechanism as claimed in claim 8 wherein the pivots about which said laterally disposed links rotate are eccentrically positioned between said first and second lateral ends.

10. The system as claimed in claim 1 wherein said electrically powered door operator includes a speed reducing torque multiplier.

11. The system as claimed in claim 1 wherein said electrically powered door operator includes a cycloidal speed reducing torque multiplier.

* * * * *

UNITED STATES PATENT AND TRADEMARK OFFICE

CERTIFICATE OF CORRECTION

PATENT NO. : 6,508,332 B2
DATED : January 1, 2003
INVENTOR(S) : Richard Lee Fahl et al.

It is certified that error appears in the above-identified patent and that said Letters Patent is hereby corrected as shown below:

Column 6,
Line 50, insert the words -- four bar -- after the word "single."

Column 7,
Line 14, delete the words "collapsing parallelogram" and insert the words -- four-bar expanding and collapsing parallelogram linkage --.

Column 8,
Line 3, delete the word "said".

Signed and Sealed this

Twenty-seventh Day of May, 2003

JAMES E. ROGAN
*Director of the United States Patent and Trademark Office*